United States Patent [19]

Zohler

[11] Patent Number: 4,921,042

[45] Date of Patent: May 1, 1990

[54] HIGH PERFORMANCE HEAT TRANSFER TUBE AND METHOD OF MAKING SAME

[75] Inventor: Steven R. Zohler, Manlius, N.Y.

[73] Assignee: Carrier Corporation, Syracuse, N.Y.

[21] Appl. No.: 395,665

[22] Filed: Aug. 18, 1989

Related U.S. Application Data

[62] Division of Ser. No. 111,917, Oct. 21, 1987, Pat. No. 4,866,830.

[51] Int. Cl.[5] ..... F28F 1/42

[52] U.S. Cl. ..... 165/179; 165/133

[58] Field of Search ..... 165/133, 179, 184

[56] References Cited

U.S. PATENT DOCUMENTS

| | | | |
|---|---|---|---|
| 3,217,799 | 11/1965 | Rodgers | 165/179 |
| 3,847,212 | 11/1974 | Withers, Jr. et al. | 165/179 |
| 4,059,147 | 11/1977 | Thorne | 165/133 |
| 4,425,696 | 1/1984 | Torniainen | 29/157.3 AH |
| 4,438,807 | 3/1984 | Mathur et al. | 165/133 |
| 4,546,819 | 10/1985 | O'Connor | 165/70 |
| 4,660,630 | 4/1987 | Cunningham et al. | 165/133 |

*Primary Examiner*—Alan Cohan
*Assistant Examiner*—Allen J. Flanigan
*Attorney, Agent, or Firm*—Bernhard P. Molldrem, Jr.

[57] ABSTRACT

A high performance heat transfer tube for use in the condenser for an air conditioning or refrigeration system is formed on a grooved mandrel which has a sufficient number of grooves i.e., thirty six to forty eight, with a suitable helix angle, such as thirty degrees, and a sufficiently small pitch, such as 0.10 inches or less, so that a Moiré imprint is avoided in the external fin enhancement. This makes the fin height uniform over the exterior of the tube, which results in an increase in condenser efficiency.

5 Claims, 1 Drawing Sheet

HIGH PERFORMANCE HEAT TRANSFER TUBE AND METHOD OF MAKING SAME

This is a division of application Ser. No. 111,917, filed Oct. 21, 1987, now U.S. Pat. No. 4,866,830.

BACKGROUND OF THE INVENTION

The present invention relates to heat exchangers, and is more particularly directed to heat exchangers which have tubes for transferring heat between a coolant liquid flowing through the tubes and a refrigerant fluid in contact with the exterior of the tubes. The present invention is more specifically directed towards tubes which have an internal rib enhancement and an external fin enhancement, and also towards an improved method for making such tubing.

In the condenser portion of certain refrigeration or air conditioning systems, a coolant fluid, such as water, is passed through heat transfer tubing while refrigerant vapor in contact with the exterior of the tubing changes state from vapor to liquid, giving up heat of condensation to the coolant liquid within the tubing. The external and internal configuration of the tubing is important in determining the overall heat transfer characteristics of the tubing, and hence in determining the efficiency of the system. With condenser tubing that has an internal rib enhancement and an external fin enhancement, the condensation activity takes place at the tips or extrema of the fin, and the condensate flows into the channels between the fins. The condensed liquid refrigerant fills the channels to a point at which the coolant drips out. An internal enhancement, in the form of spiral or helical ribs or fins, causes a swirling of the flowing coolant within the tube. This induces some turbulence, which breaks up laminar flow and thus also prevents any insulating barrier layer from forming at the inner wall of the tube.

Tubes that are given both an internal and external enhancement are described, for example, in the commonly-assigned U.S Pat. No. 4,425,696. Although that patent is directed to an evaporator, rather than a condenser tube configuration, a heat transfer tube suitable for use as a condenser tube could be constructed on the same tube finning machine, omitting the step of rolling the fins that is described in that patent. Other finned tubes for heat transfer are described in U.S. Pat. Nos. 4,059,147 and 4,438,807.

In the tube finning machine employed in the production of this tubing, a cylindrical grooved mandrel within the tube produces the internal rib, while a tool gang of discs carried on a tool arbor produces a fin convolution on the exterior of the tubing. The force of the gang of discs on the metal tubing and against the mandrel causes the metal of the tubing to flow up between the discs to form the fins and down into the mandrel grooves to form the ribs. At the locations of the grooves, however, there is less force placed on the metal, and the tubing metal does not flow as far outward between the discs of the tool gang. As a result, there is a reduced height in the external fin at locations which correspond to crossings of the fins with the internal rib. This produces a visually noticeable Moire pattern in the fins. Generally, the external fin has a height of about 0.030 inches, but the extent of dip or shortening due to this Moire imprint is about 0.005 to 0.008 inches.

As aforementioned, in a condenser tube the tips or extrema of the fin is where most of the condensation activity takes place. However, because of the significant Moire reduction in height, where the fin crosses the path of the rib the amount of exposed fin is significantly reduced. The reduction in efficiency of condensation of refrigerant can exceed twenty-eight percent, as compared to a finned tube where the fin height is uniform over the circumference of the tube.

A way to produce condenser tubes with a uniform external fin height with an internal enhancement has long been sought, but no one has previously been able to produce such a tube.

OBJECTS AND SUMMARY OF THE INVENTION

Accordingly, it is an object of this invention to provide a heat transfer tube having superior efficiency characteristics when employed as a condenser tube.

Another object of the present invention is to provide an efficient method for making high performance heat transfer tubes for use as condenser tubes in a refrigeration or air conditioning system.

More specifically, it is an object of this invention to provide fin- and rib-enhanced tubing, and a method of making same, which avoids the Moire imprint on the external fins.

In accordance with an aspect of this invention, a heat transfer tube is produced with a plurality of helically extending interior ribs and at least one helically extending fin, with the fin defining open channels in which the condensed refrigerant coolant can collect. According to this invention, the interior ribs are disposed at sufficiently small pitch, and with a suitable helix angle, so that the exterior fin is formed without a Moire reduction in height at the positions where the exterior fins cross the interior ribs, and so that the distance from base to tip of the fin is substantially uniform. Preferably there are 36 to 48 of said internal ribs taken around the internal circumference of the tube, and the helix angle of the internal rib is on the order of about 30 degrees. This tubing is made employing a mandrel that has about 36 to 48 helical grooves thereon which are cut with a helix angle of substantially 30 degrees. The mandrel grooves have a pitch on the order of 0.10 inches or less, and in a preferred embodiment of 0.070 inches.

The use of a mandrel having a high number of internal fins with a small pitch results in a decrease in the Moire imprint. When the number of grooves on the mandrel was increased from the now-standard fourteen grooves (with a 45 degree helix) to thirty-six grooves or forty-eight (with a 30 degree helix) the Moire imprint was reduced and virtually eliminated in the case of the forty-eight groove mandrel. The reduction in Moire imprint was accompanied by an increase in both the refrigerant side performance, approaching that of a smooth internal finned tube, and in overall tube performance. That is, by using more grooves and reducing the helix angle, an increase in performance was obtained on the coolant side. Even though there were more grooves than in previous attempts, there was no sacrifice in pressure drop performance on the water or coolant side of the tube because of the corresponding reduction in helix angle.

It is thought that the internally ribbed tubes with helical fins, with their characteristic Moire imprint, have a wider finned tip in the depressed region of the Moire, and this affects the condensate film thickness, and liquid drainage characteristic in that area. This, in turn, results in lowering the condensate efficiency. That is, by reducing the Moire imprint effect on the fins, there will be a higher condensing coefficient. Previously, such an elimination or reduction in the Moire imprint was achievable only by producing a smooth or unenhanced inside surface of the tube. However, this reduced the water-side or coolant-side efficiency and limited the overall performance of the tube. Also, if the helix angle of the internal fin were selected to be high to correspond with the helix angle of the external fins, the water-side or coolant-side pressure drop would become too great, and efficiency would actually drop. However, with the tube enhancement according to this invention, the Moire imprint is substantially eliminated, while maintaining optimum coolant-side pressure drop and heat transfer characteristics.

The above and many other objects, features, and advantages of this invention will be more fully understood from the ensuing description of a preferred embodiment, which should be read in connection with the accompanying Drawing.

DETAILED DESCRIPTION OF THE PREFERRED EMBODIMENT

An embodiment of the present invention as described below has designed especially for use in a condenser of a refrigeration or air conditioning system of the type in which a coolant liquid, which can be water, passes through the interior of the heat transfer tubes, and in which a refrigerant is condensed from vapor form to liquid form in contact with the external surfaces of the tubes. Typically, there are a multiplicity of these heat transfer tubes mounted in parallel and connected so that several tubes form a fluid flow circuit and there are several of such parallel circuits provided to form a tube bundle. Usually, all of the tubes of the various fluid flow circuits are contained within a single casing that also contains the refrigerant in the form of a condensed vapor or gas. The heat transfer characteristics of the condenser are largely determined by the heat transfer characteristics of the individual condenser tubes.

Figure 1:
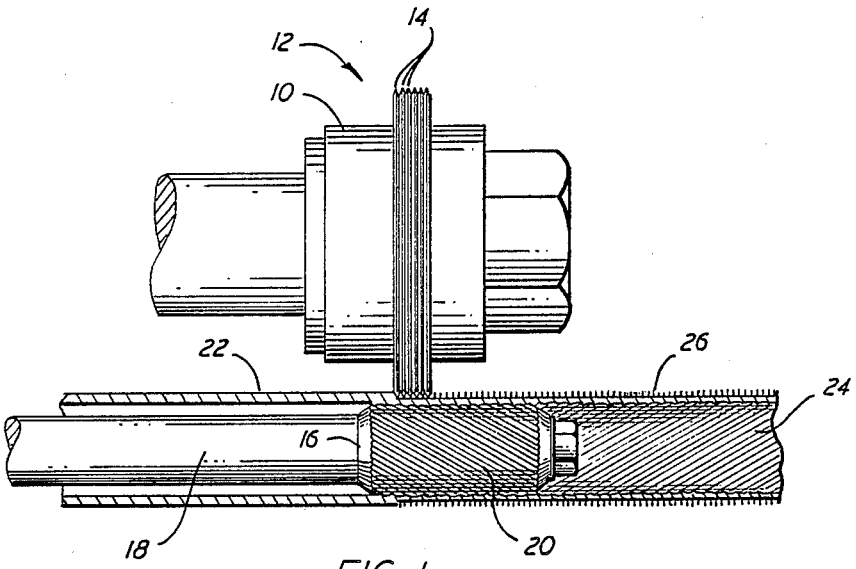
FIG. 1 is a schematic sectional view of a condenser tube in the process of production, a grooved mandrel, and a tool arbor with tool gang for rolling a tube on the grooved mandrel to form the helically finned and ribbed heat transfer tube according to this invention.

Referring now to the drawing, and initially, to FIG. 1 thereof, a tube finning machine is shown in elevational cross section, and this machine comprises a tool arbor 10 with a tool gang 12 formed of a plurality of discs 14. At the axial position of the tool gang 12, there is disposed a mandrel 16 mounted on a mandrel shaft 18. The mandrel has a number of grooves 20 cut therein which correspond to the pattern of ribs that are to be formed in the tube. In this case, the mandrel 16 has forty-eight grooves 20, as opposed to the fourteen grooves that are found on the mandrel that is used in conventional enhanced tube manufacture. These helical grooves 20 have a helix angle of about thirty degrees, and are at a pitch or spacing of 0.070 inches.

Figure 2:
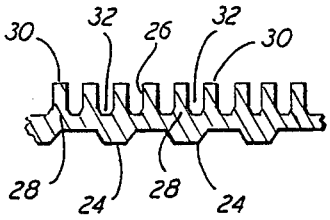
FIG. 2 is an enlarged sectional view of the tube wall of the heat transfer tube with fin and rib enhancements according to this invention.

A tubular workpiece 22 in this embodiment is a copper blank tube of $\frac{3}{4}$ inch nominal outside diameter. The workpiece is supported on the mandrel 16 beneath the tool gang 12, and the discs 14 on the arbor 10 are brought into contact with the tubular workpiece at a small angle relative to the longitudinal axis of the workpiece. This small amount of skew provides for a longitudinal driving of the workpiece 22 as the arbor 10 is rotated. The discs 14 displace the copper material of the tube wall, causing the material to flow downward into the grooves 20 to form an internal rib enhancement 24 and to flow up between the discs 14 to form an external fin convolution 26. As shown in more detail in FIG. 2, the fin structure 26 generally has a base 28 towards the axis of the tube and in contact with the tube wall, and a tip 30 remote from the tube wall. The base 28 is somewhat wider, axially, than the tip 30. Channels 32 are defined by spaces between the fins, and serve as locations for the condensed refrigerant to collect.

As aforementioned, the height of the fin, that is, the base-to-tip spacing, should be uniform everywhere along the circumference of the tube 22. The fin 26 also has a profile that is uniform over the circumference of the tube 22. This is achieved with the internal rib enhancement having the number of helical ribs, pitch, and helix angle according to this invention.

Figure 3:
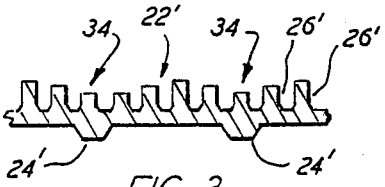
FIG. 3 Prior Art
FIG. 3 is an enlarged sectional view of a heat transfer tube of the prior art.

As shown in FIG. 3 for comparison purposes, in the condenser tube of the prior art, in a condenser tube 22' of the prior art, the internal rib enhancement 24' has a greater pitch or spacing between the internal ribs, and as a consequence in the external fin enhancement 26', there is a dip 34 or shortening of the fin at the crossings of the fin 26' with a rib 24'. This shortening or Moire results in a non-uniformity of about three to eight mils, and limits the exposure of the fin enhancement 26' that is available for condensing the refrigerant.

While the present invention has been described with respect to a preferred embodiment, it should be recognized that many modifications and variations would be apparent to those of skill in the art without departing from the main principles of this invention. It should be recognized, for example, that for tubing made of a different material, or with a different diameter or tube wall thickness, a mandrel 16 having a different number of helical grooves 20 or having the grooves 20 at a different helix angle or with a different pitch, might be employed. Also, while the preferred embodiment described here relates to a condenser tube, the same principles could readily be transferred to the production of an evaporator tube. Accordingly, it should be understood that many other embodiments of the present invention may be made without departing from the scope and spirit of this invention as described herein and as defined in the appended claims.

What is claimed is:

1. In a heat transfer tube for transferring heat of condensation of a refrigerant fluid outside the tube to a circulating coolant liquid inside the tube and which is enhanced with a plurality of helically extending interior ribs on the interior surface of the tube for inducing turbulence in the circulating coolant liquid and at least one helically extending exterior fin about the exterior of the tube extending radially outward from a base portion disposed toward the tube axis to a tip portion radially remote from said axis, the fin defining at least one open channel in which the condensed refrigerant fluid can collect; the improvement wherein said external fin has a substantially uniform profile over the circumference of the tube, and said interior ribs are disposed at sufficiently small pitch that the exterior fin is formed without a Moire reduction in height at the positions where the exterior fin crosses the interior ribs and the distance from the base to tip of said fin is substantially uniform.

2. The heat transfer tube according to claim 1 in which there are at least 36 of said internal ribs.

3. The heat transfer tube according to claim 2 in which said ribs have a helix angle on the order of 30 degrees.

4. The heat transfer tube according to claim 1 in which the internal ribs have a pitch on the order of 0.10 inches or less.

5. The heat transfer tube according to claim 1 in which there are 48 internal ribs with a helix angle of about 30 degrees.

* * * * *